United States Patent [19]

Wolak et al.

[11] 4,048,755

[45] Sept. 20, 1977

[54] FULL LENGTH DOOR ARRANGEMENT FOR RAILWAY HOUSE CAR

[75] Inventors: Norbert S. Wolak; Thomas J. Wolak, both of Cicero, Ill.

[73] Assignee: Evans Products Company, Portland, Oreg.

[21] Appl. No.: 695,382

[22] Filed: June 14, 1976

[51] Int. Cl.[2] ..... E05D 15/10

[52] U.S. Cl. ..... 49/130; 49/220; 49/225

[58] Field of Search ..... 49/130, 129, 128, 127, 49/125, 209, 216, 218, 219, 220, 221, 225

[56] References Cited

U.S. PATENT DOCUMENTS

| | | | |
|---|---|---|---|
| 2,931,079 | 4/1960 | Soddy | 49/219 X |
| 3,056,176 | 10/1962 | Soddy | 49/125 |
| 3,245,125 | 4/1966 | Madland | 49/220 |
| 3,786,599 | 1/1974 | Galbarzyk | 49/220 |
| 3,913,269 | 10/1975 | Ross, Jr. | 49/220 |

*Primary Examiner*—Philip C. Kannan
*Attorney, Agent, or Firm*—F. Travers Burgess

[57] ABSTRACT

A railway house car side has an elongated opening closed by four doors disposed in end-to-end relation lengthwise of the car with respect to each other, two of the doors, which may be designated end doors, being movable solely lengthwise of the car to uncover the end portions of the opening, the other two doors, which may be designated center doors, being movable transversely, to disalign them transversely of the car side from the end doors and lengthwise of the side alongside of the end doors to uncover the center portion of the opening. The edges of the end doors nearest the respective ends of the car side have beveled flanges engageable with outwardly diverging door stops on the car side to wedge the end doors against the car side when closed and the opposite edges of the end doors have flanges overlaid by the adjacent center door edges to hold the end doors against the car side, and the edge of one center door overlies that of the other to afford a seal between them. Each end door is provided with a manually actuable device for unwedging the door and initiating its opening movement. As a safety feature the side plate of the car mounts a common top retainer rail for both sets of doors comprising a generally S-section elongated member having an upwardly open inner channel forming the top retainer for the center door cranks and a downwardly open outer channel forming the top retainer for the end doors. The side plate also mounts an outwardly extending ledge overlying the inner retainer channel to prevent the center door crank terminals from rising out of the inner retainer channel, and the web and outer depending flange of the outer retainer channel provide additional obstacles to outward movement of the center door top crank terminals in the event of failure of the common vertical web separating the two channels. An idler safety retainer crank on each door in addition to the operating retainer cranks prevents separation of the door from the car side if the operating retainer cranks fail. Novel gasket construction provides an improved seal between the adjacent doors and between the doors and the car side sill and side plate.

28 Claims, 22 Drawing Figures

FULL LENGTH DOOR ARRANGEMENT FOR RAILWAY HOUSE CAR

BACKGROUND OF THE INVENTION

1. Field of the Invention

The invention relates to railway rolling stock and more particularly to house cars of the type in which the sides are wholly formed of movable doors, partly of the transversely movable and longitudinally slidable type and partly of the longitudinally slidable type and consists particularly in an improved arrangement of the doors, safety features and an improved seal for such doors.

2. The Prior Art

The prior art includes cars in which there are two sets of adjacent doors covering an elongated opening and having a pair of parallel supporting tracks on the car side sill and a pair of parallel retainer rails on the car side plate. Thomas C. Soddy U.S. Pat. No. 3,056,176, which is owned by the assignee of the present application, discloses and claims a structure of this type in which one of the doors is a simple sliding door and the other door is a plug door with mounting cranks of sufficient length to permit the plug door to be moved transversely outwardly of the sliding door and longitudinally abreast of it to clear the opening.

In cars of the all-door type, the elongated opening may be closed by four plug doors, each of which is supported from the car side by a pair of rotatable mounting shafts and associated crank arms along with mechanism for operating the shaft. This arrangement requires that all four doors be equipped with relatively complex means for shifting them transversely of the car side.

In another prior art embodiment of all-door type cars, the combination of plug and sliding doors disclosed in U.S. Pat. No. 3,056,176 is utilized, the car side being closed by one or more simple sliding doors adjacent each end of the car side and a pair of adjacent plug doors at the middle of the car side, one of the plug doors being in overlapping relation with the other plug door and both plug doors being in overlapping relation with the adjacent vertical edges of the simple sliding doors, the edges of the sliding doors remote from the plug doors being overlaid by flanges on the adjacent edges of the adjacent plug doors. In this arrangement, no means is provided for maintaining the edges of the simple sliding doors remote from the plug doors in tight engagement with the car side sill and side plate so that during movement of the car the simple sliding doors would be free to move into and out of engagement with the side sill and side plate with consequent noise, frictional wear on the sliding door rollers and track, inferior weather tightness and weakening of the car structure.

In the previous door arrangements referred to above, the top retainer rails have been at different levels and have had a single vertical flange depending from a transverse flange or web on the side plate. In cars having a full length door opening with the side plate and roof unsupported between the car ends, substantial deflection of the unsupported side plate frequently causes frictional wear between the top retainer crank rollers and the top retainer rail flange, resulting in the destruction of the rollers and the cutting through the flange and the door falling off the car, with consequent danger to personnel and railroad property.

SUMMARY OF THE INVENTION

An object of the invention is to provide an all-door side for a railway house car consisting of two end doors of the longitudinal sliding type and two center doors of the transversely and longitudinally movable type, in which the end doors are securely held in tight engagement with the car side surfaces by co-operating wedging means on the car corner posts and the adjacent edges of the end doors and by overlying engagement of the adjacent edges of the center doors with those of the end doors, one of the center doors overlyingly engaging the adjacent edge of the other. This arrangement provides a tight sealing engagement between the end doors and the outer surfaces of the car side as well as between the center doors and the outer surfaces of the car side, eliminating the need for complex means for holding the end doors in tight engagement with the car side when closed.

Another object is to improve the safety of such door arrangements by provision of means positively preventing separation of the center door top retainer cranks from the retainer rail. This object is achieved by the provision of a retainer rail of S-section having an upwardly open inner channel to receive the depending rollers on the top retainer crank arms and a downwardly open outer channel, the inner vertical leg of which is formed by the outer vertical leg of the inner channel, to provide a top retainer for the longitudinally slidable doors and additional reinforcements on the outer web of the inner channel, such that in the event of failure of the web of the inner channel the retainer crank parts could not separate from the car.

As a corollary to the previous object, to enhance the safety feature described therein, the car side plate mounts a ledge overlying the inner channel of the retainer rail and the terminals of the top retainer cranks to positively prevent their lifting out of the retainer rail in the event of excessive deflection of the long unsupported span of the side plate.

A further object is to provide an improved seal between the center doors and the car side plate and side sill, and the adjacent edges of the end doors, whereby the noncoplanarity between the outer surfaces of the edge flanges on the end doors and on the underlying center door on the one hand and the outer surfaces respectively of the side plate and side sill on the other hand is compensated for such that any voids in the gaskets adjacent the edge flanges caused by such noncoplanarity are filled by tapered resilient flaps on the flanges.

DETAILED DESCRIPTION OF THE INVENTION

Figure 1A:
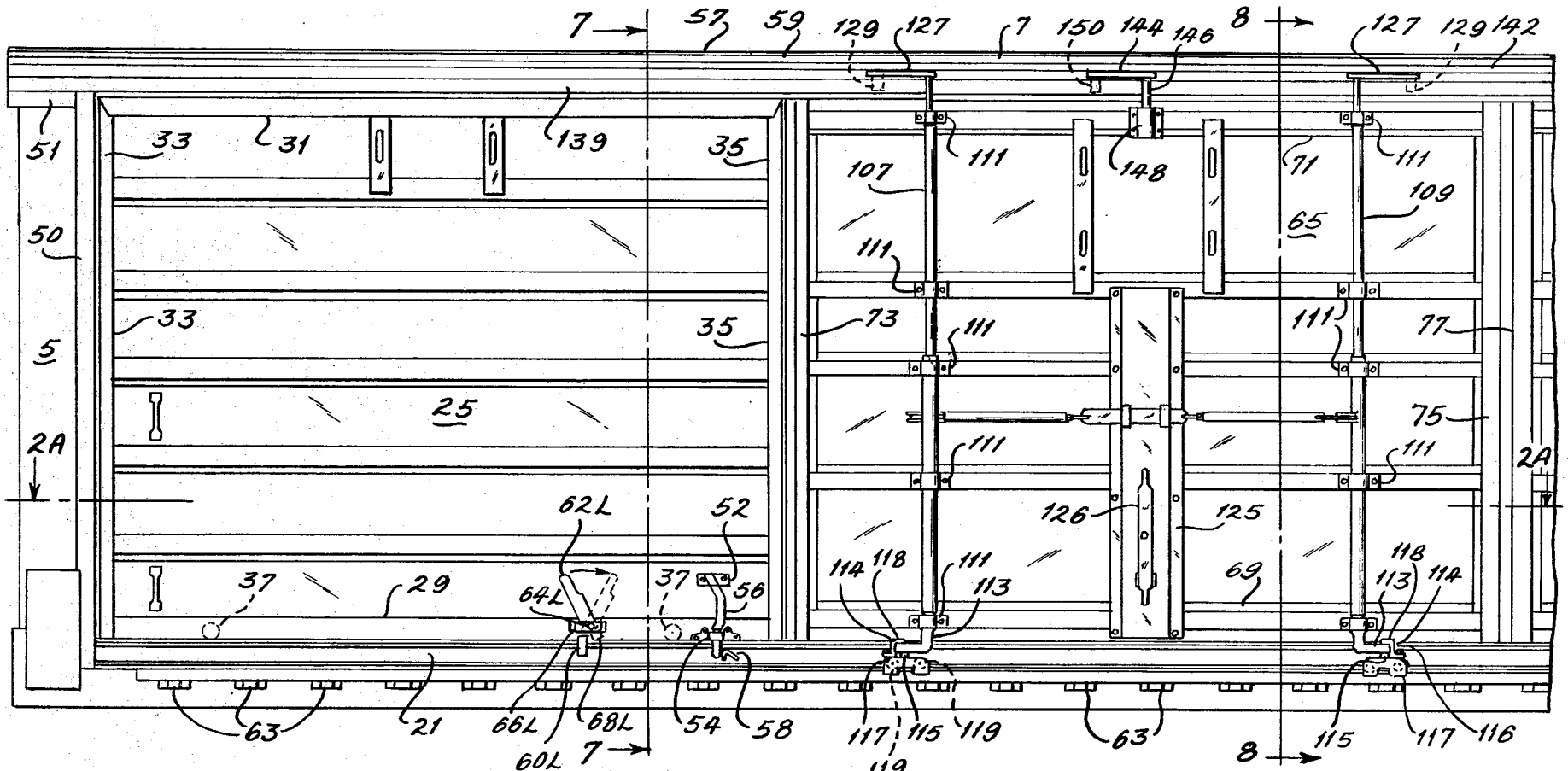
FIGS. 1A and 1B are complementary side elevational views respectively of the left and right halves of a railway house car side incorporating the invention.

The numeral 1 generally designated a railway car side comprising a longitudinally extending side sill 3 mounting at its ends vertical corner posts 5, and a longitudinally extending side plate 7 supported at its ends on the upper ends of corner posts 5 and defining, with corner posts 5 and side sill 3, an elongated rectangular opening substantially the full length and full height of the car side 1.

Side sill 3 has a vertical web 9 and, along its upper edge, an inwardly extending flange 11, and each of the corner posts 5 has a web 15 co-planar with side sill web 9 and an inwardly extending flange 17 defining the end of the door opening.

Below the top of side sill web 9, a first door mounting track, comprising an inverted L-section member 21 is mounted on and spaced from side sill web 9 by bar 23 and extends parallel to the side sill web the full distance between corner posts 5 and slightly therebeyond. A pair of sliding end doors 25, 27 each has a panel sheet 28 secured at its margins to bottom edge member 29, a top edge member 31, vertical edge members 33 and 35. Rollers 37 are journaled in the protrude below bottom edge member 29 to support doors 25 and 27 on the upper surface of track member 21 for movement lengthwise thereof. Bottom edge member 29 is formed with a downturned inner flange 39 which depends between track member 21 and the outer surface of side sill web 9 to provide limited, while preventing substantial, transverse outward movement of end doors 25 and 27 with respect to track member 21.

To edge member 31 of end doors 25 and 27 are of generally Z-cross section comprising a deep vertical outer flange 41, a relatively narrow horizontal web 43 and an upstanding inner flange 45 with its upper terminal 47 bent inwardly, door sheets 28 being secured to the inner surfaces of top edge member inner flange 45 and bottom edge member inner flange 39 and being adapted for engagement with the outer surfaces of the side sill web 9 and vertical bottom flange 51 of side plate 7 when the doors are closed.

For maintaining the vertical edge of each of the end doors 25 and 27 nearest the respective corner post 5, when closed, in tight engagement against the outer surface of the car side members, the vertical edge members 33 of end doors 25 and 27 are of Z-cross section having an inner flange 48 directed toward the adjacent corner posts 5. The outer margin 49 of flange 48 is rebent outwardly and away from the adjacent post 5 on a bevel, and each corner post 5 mounts a door stop member 50 diverging outwardly toward the door opening, which wedgingly engages the end door flange margin 49 to urge the inner surface of the respective end doors into tightly abutting engagement with the flush outer surfaces of side sill web 9, corner posts 5 and side plate flange 51.

Figure 20:
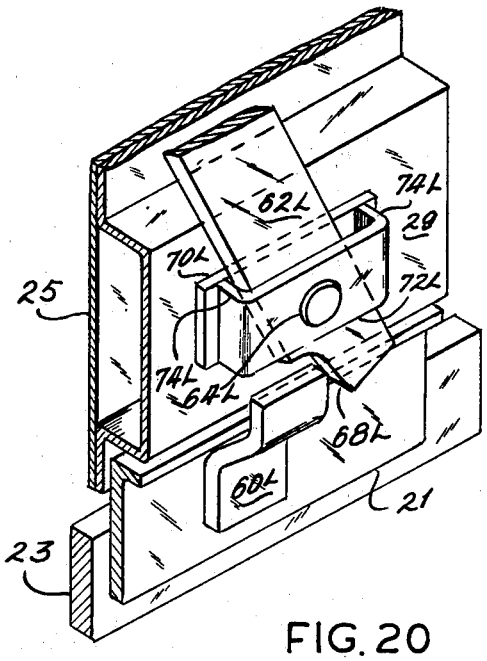
FIG. 20 is an enlarged isometric view of a portion of the lefthand sliding door and adjacent portion of the sliding door track showing the door starting device.

For releasing end door 25 from its wedging engagement with corner post door stop member 50, and initiating rightward opening movement of end door 25, a device (FIGS. 1A and 20) comprises a small outwardly and upwardly projecting stop or abutment 60L fixedly mounted on sliding door track 21 and a lever 62L fulcrumed on pin 64L to a bracket 66L on bottom edge member 29 of end door 25 positioned such that when door 25 is in fully closed position, the downwardly projecting end portion 68L of lever 62L will be spaced a slight distance to the right from abutment 60L, whereby the door can be unwedged and started by pulling the upper handle end of lever 62L clockwise and causing the lower end 68L to engage the opposed surface of abutment 60L. As best seen in FIG. 20, mounting bracket 66L has a flat base plate 70L welded to door bottom edge member 29 and a cover plate 72L with its ends 74L bent inwardly to form stops limiting the inclination of lever 62L to the positions shown in FIG. 1A.

Figure 1B:
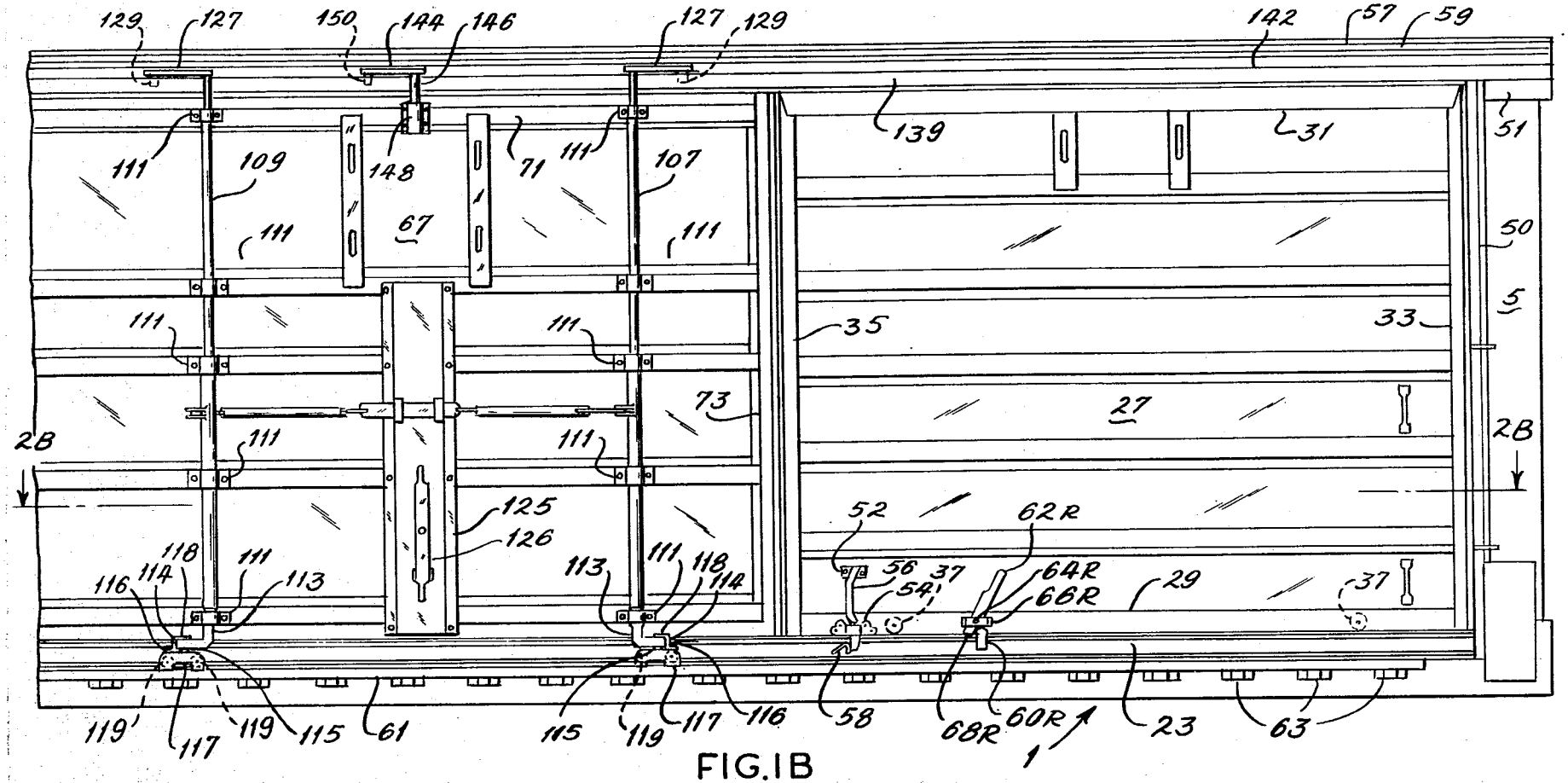

For unwedging and starting opening movements of righthand end door (FIG. 1B), a similar abutment 60R is mounted on sliding door track 23 beneath end door 27 and a lever 62R is fulcrumed at 64R in a bracket 66R with its lower end 68R normally spaced to the left of abutment 60R, such that by manually moving lever 62R counterclockwise about fulcrum 64R, the lower projecting end 68R of the lever can be brought into engagement with the lefthand edge of abutment 60R to unwedge end door 27 and initiate its leftward opening movement.

Each of the end doors mounts near its edge adjacent the center doors a pair of vertically spaced brackets 52 and 54 in which are vertically slidably received lift handles 56 which normally project below bottom edge members 29 and there engage safety stops 58 mounted on track 21.

In addition to bottom flange 51, which forms the header of the elongated door opening, side plate 7 is of generally outwardly open channel cross section having a vertical web 53, an outwardly extending horizontal bottom flange 55 which terminates in vertical bottom flange 51, and an outwardly extending slightly downwardly inclined top flange 57, the outer terminal 59 of which is rebent vertically downwardly.

At a lower level than first door track member 21 and laterally outwardly thereof, a second door track member 61 of inverted angle section is supported in parallel relation with side sill web 9 by hat-section spacers 63.

Transversely movable and longitudinally slidable center doors 65 and 67 have panel sheets 79 and 80 respectively secured along their margins to bottom edge members 69, top edge members 71, remote vertical edge members 73 and, respectively, adjacent vertical edge members 75 and 77.

Figure 2A:
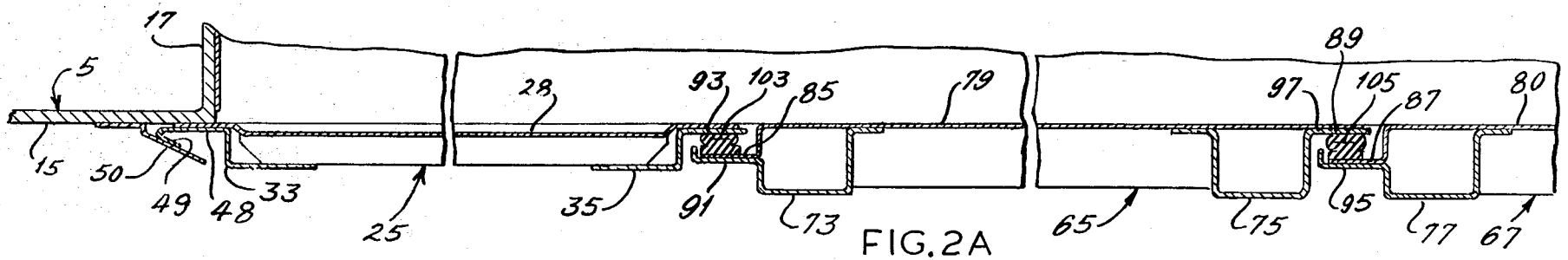
FIGS. 2A and 2B are complementary horizontal sectional views taken respectively along lines 2A—2A of FIG. 1A and 2B—2B of FIG. 1B.
Figure 2B:
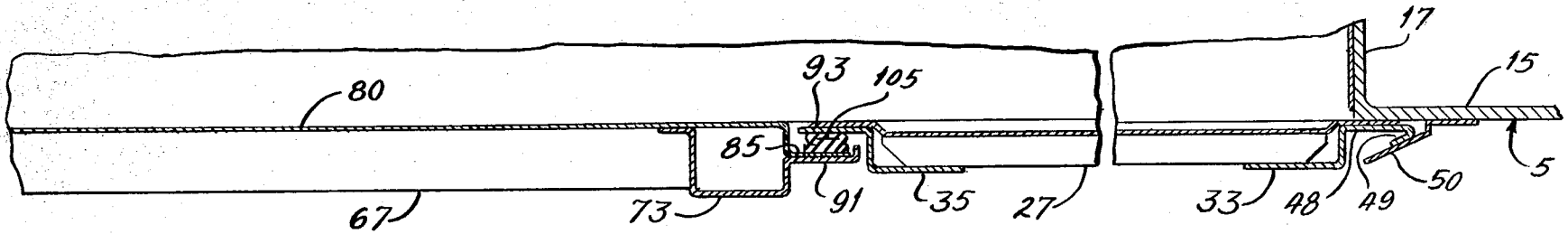
Figure 8:
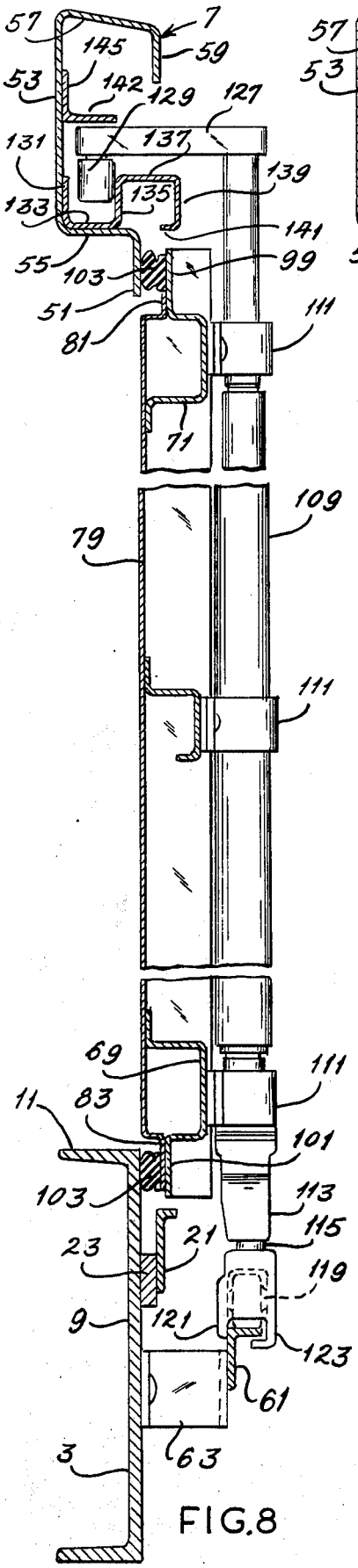
FIGS. 7 and 8 are vertical sectional views taken respectively along line 7—7 and 8—8 of FIG. 1A.
Figure 7:
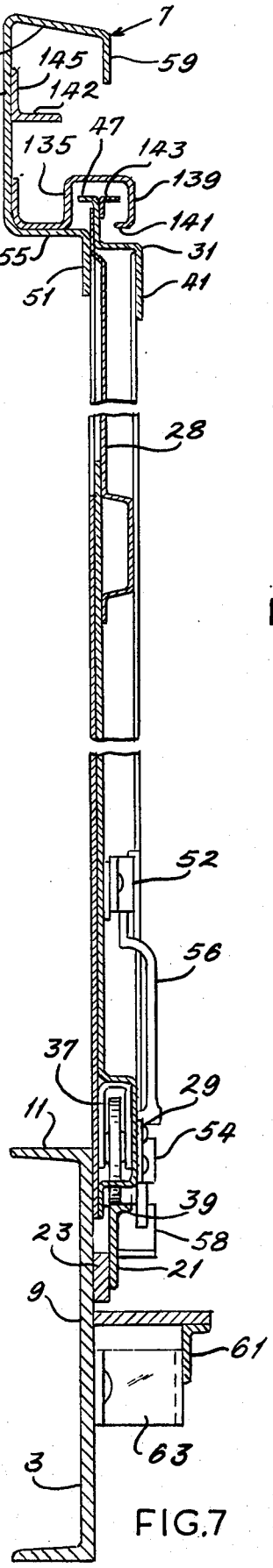
Figure 9:
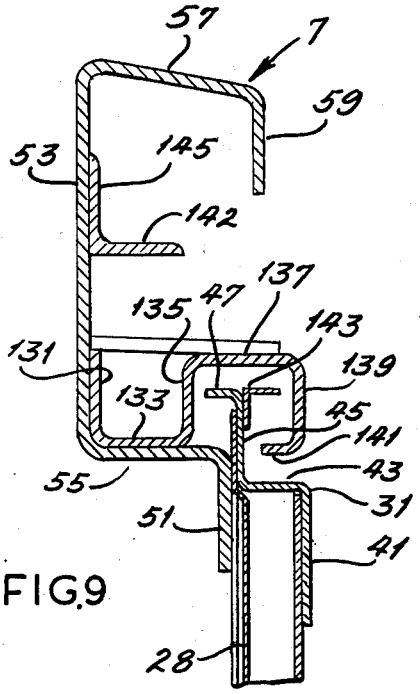
FIGS. 9 and 10 are respectively enlarged fragmentary vertical sectional views of the side plate and adjacent portions of the center and end doors.

Top and bottom marginal portions 81 and 83 of panel sheets 79 and 80 are offset outwardly from the general plane of sheets 79 and 80, as best seen in FIG. 8, with regard to panel sheet 79. The remote vertical margins of sheets 79 and 80 are correspondingly offset outwardly at 85 as is the margin 87 of sheet 80 secured to vertical edge member 77 of center door 67, the adjacent marginal portion 89 of sheet 79 being co-planar with the general plane of sheet 79, as best seen in FIGS. 2A and 2B. With the doors in closed position, as seen in FIGS. 2A and 2B, the edge flanges 91 on remote vertical edge members 73 of center doors 65 and 67 overlie edge flanges 93 of vertical edge members 35 of end doors 25 and 27 and flange 95 on vertical edge member 77 of center door 67 overlies edge flange 97 on the adjacent vertical edge member 75 of center door 65. Top and bottom marginal portions 81 and 83 of sheets 79 and 80 are similarly secured to the inner surfaces of top and bottom flanges 99 and 101 on top and bottom edge members 71 and 69 of doors 65 and 67.

The marginal portions 81, 83 and 85 of center door 65 mount a three-sided inwardly facing resilient gasket member 103 which, when center door 65 is in closed position with its panel sheet 79 substantially co-planar with the outer surfaces of the side sill web 9 and side plate flange 51, are compressed against these latter members and against edge flange 93 on door 25.

Figure 12:
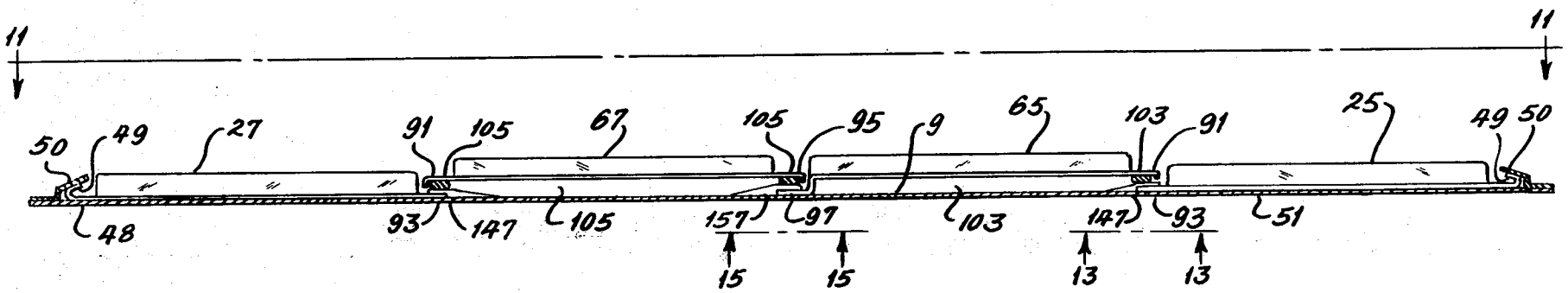
FIG. 12 is a simplified top view taken from line 12—12 of FIG. 11 but showing the doors in closed position.
Figure 13:
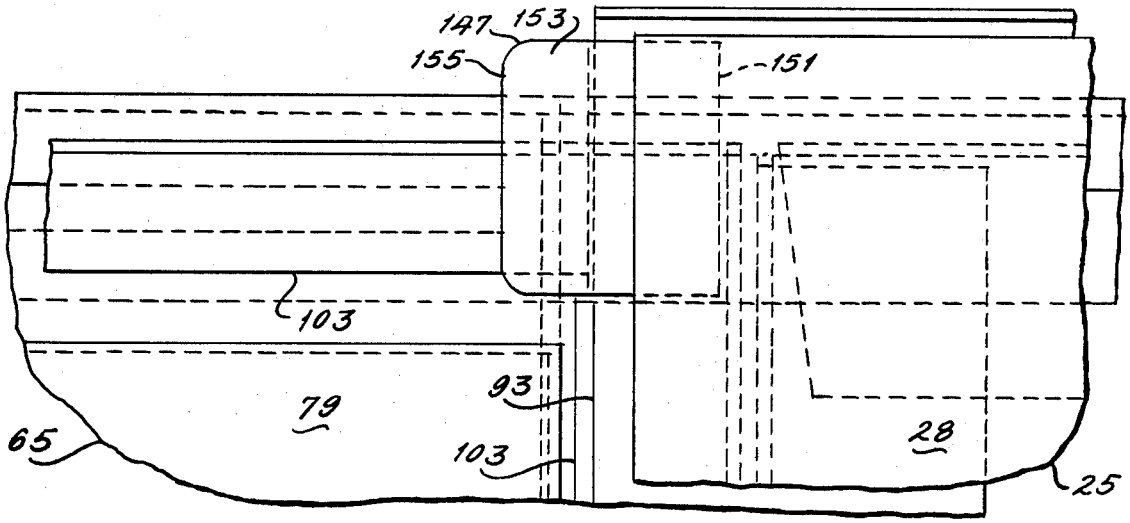
FIG. 13 is an enlarged fragmentary inside elevational view taken from line 13—13 of FIG. 12.
Figure 14:
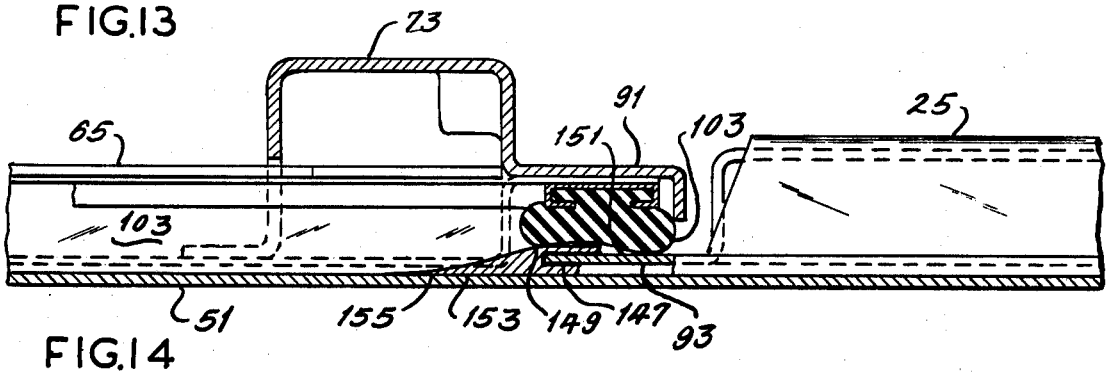
FIG. 14 is an enlarged fragmentary top view taken from line 14—14 of FIG. 11.

As will be best understood by reference to FIGS. 2A, 2B and 12, when all of the doors are fully closed, their innermost surface portions are outwardly of the common vertical plane of the outer surfaces of side sill web 9, corner post webs 15 and side plate vertical flange 51 and hence no parts of any of the doors protrude into the opening defined by the respective edges of these members.

The top, bottom, and vertical marginal portions 81, 83, 85 and 87 of sheet 80 of center door 67 mount a four-sided gasket 105 which, when the door is fully closed, is compressed against side sill web 9, side plate flange 51, and edge flanges 97 and 93 respectively of center door 65 and end door 27.

Center doors 65 and 67 are arranged to be supported on track member 61 for movement transversely outwardly of their closed position, in which their inner surfaces are flush with each other and with end doors 25 and 27 to open positions in which they overlie end doors 25 and 27 to provide double-door width openings at either end of the car side or intermediate the ends thereof, as best seen in FIGS. 3–6.

For supporting center doors 65 and 67 on track member 61, a pair of vertical mounting shafts 107 and 109 are journaled on each of the center doors at 111 and mount at their lower ends mounting cranks 113 which are pivoted at 115 to roller carriages 117 mounting rollers 119 riding on track 61. To prevent cranks 113 from lifting off roller carriages 117, a small bracket 114 of generally Z-section is secured by its lower flange 116 to the upper surface of each carriage 117 with its upper flange 118 overlying the terminal of the respective mounting crank 113. For preventing separation of roller carriages 117 from track 61, each carriage is provided with an inward depending element 121 engageable with the inner surface of track member 61 and a hook-like outer depending element 123 adapted to underlie the horizontal flange of track member 61.

For rotating mounting shaft 107 and 109 each center door may be provided with a leverless operator 125 of the type disclosed in co-pending application of Alfons W. Ceyer, Ser. No. 602,284, filed Aug. 6, 1975, issued May. 3, 1977 as U.S. Pat. No. 4,020,594, and assigned to the assignee of the present application, whereby rotation of the shafts is effected by manually actuating operating handle 126, although it will be understood that any other appropriate means can be used for rotating the mounting shafts 107 and 109 between door-open and door-closed positions.

At their upper ends mounting shafts 107 and 109 mount top retainer crank arms 127, the remote ends of which have depending terminals on which are journaled rollers 129.

For retaining the doors on the car side a top retainer rail of generally S-cross section has an inner vertical flange 131 abutting side plate vertical web 53, a horizontal web 133 abutting and secured to side plate horizontal flange 55, a second vertical web 135 which defines, with flange 131 and web 133, an upwardly facing channel into which top retainer crank rollers 129 depend and engage the inner surface of vertical web 135.

As a safety feature to prevent center doors 65 and 67 from falling off the car in the event that relative vertical movement between vertical web 135 and roller 129 should wear out the roller and wear through web 135, and to provide a top retainer rail for main doors 25 and 27, the S-shaped retainer rail member also includes a second top horizontal web 137 extending outwardly from the upper end of vertical web 135, and having at its outer end a depending vertical flange 139, the lower margin of which is rebent inwardly at 141. The outer portion of side plate horizontal flange 55, vertical web 135, horizontal web 137, outer vertical flange 139 and its inwardly bent margin 141 form a downwardly open channel, or more precisely, a downwardly open box-section having a slot defined in its lower wall between the outer surface of side plate vertical flange 51 and margin 141 of flange 139 and the upper flange 45 and inwardly bent terminal 47 thereof and extend through this slot and into the interior space defined by webs 135, 137, flange 139, its horizontal margin 141 and side plate horizontal flange 55. An angle section member 143 is secured to the outer surface of upright web 45 of each end door 25 and 27 with one of its webs extending horizontally outwardly therefrom at the same level as flange horizontal terminal 47 to form, in effect, a T-shaped upper end on the top edge members 31 of end doors 25 and 27. With this arrangement, it will be seen that outer vertical flange 139 and its inwardly bent margin 141 will prevent horizontal outward movement of the tops of end doors 25 and 27, but the flanges formed by terminal 47 and angle section member 143 on the upper end of top reinforcement members 45 would engage side plate flange 55 and outer vertical flange horizontal terminal 141 in the event that the bottoms of the end doors became disengaged from track member 21.

As an additional precaution against separation of top retainer cranks 127 from the inner upwardly facing channel retainer rail formed by S-shaped member flange 131 and webs 133 and 135, a horizontal ledge is formed on vertical web 53 of side plate 7 above the inner terminals of crank arms 127 by the horizontal flange 142 of an angle member, the other flange 145 of which is welded to side plate web 53.

For positively preventing the center doors 65, 67 from falling off the car side in the event of failure of retainer cranks 127, a third top retainer safety crank 144 has a short shaft 146 freely journaled in a bearing 148 secured to top edge member 71 of each of the center doors 65 and 67 intermediate top bearings 111 of operating shafts 107 and 109. The end of each crank 144 remote from shaft 146 mounts a depending roller 150 which extends into top retainer channel 131, 133, 135, and in the unlikely event of failure of retainer cranks 127, will engage the inner surface of web 135 to prevent the door from falling off the car side.

As previously described, the vertical portions of four-sided gasket 105 on center door 67 are compressed between flanges 91 and 95 on center door 67 and flanges 93, 97, respectively, on end door 27 and center door 65, the intermediate portions of the top and bottom legs of gasket 105 engaging, respectively, the side plate and side sill outer surfaces which are not co-planar with the outer surfaces of the underlying end door flange 93 and other center door flange 97.

Similarly a non-coplanar relationship exists between the outer surface of flange 93 on the end door 25 adjacent center door 65 whereby the three-sided gasket 103 on center door 65 is more fully compressed between flange 91 on center door 65 and flange 93 on the adjacent end door 25 than is the remainder of the gaskets, i.e. the top and bottom legs of gasket 103 which directly engage side sill web 9 and side plate bottom flange 51.

To compensate for the non-coplanarity described above, each of the flanges 93 of end doors 25 and 27 mounts at its upper and lower ends a small flap 147 of elastomeric material having a thick end 149 grooved and bonded to a J-shaped metal backer 151 for securement as by welding to flanges 93, and a projecting portion 153 tapering to a vertical knife edge 155 and adapted to eliminate any void between gaskets 103 or 105 and the side plate or side sill caused by the distortion of the upper corners of gaskets 103 and 105 by flanges 93.

Figure 15:
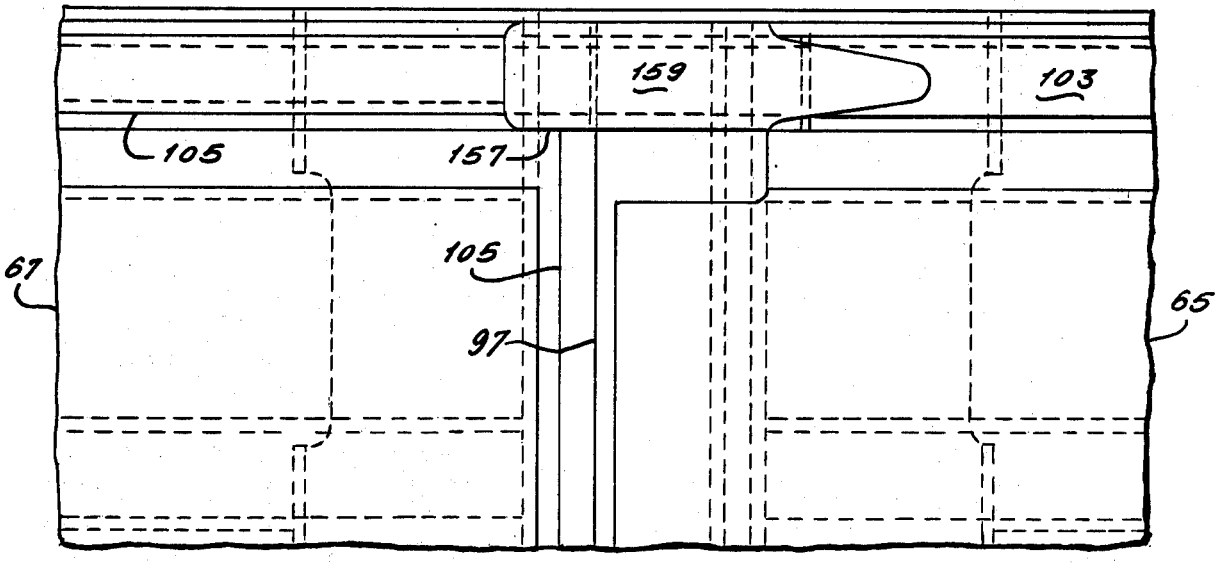
FIG. 15 is an enlarged fragmentary inside elevational view taken from line 15—15 of FIG. 12.
Figure 16:
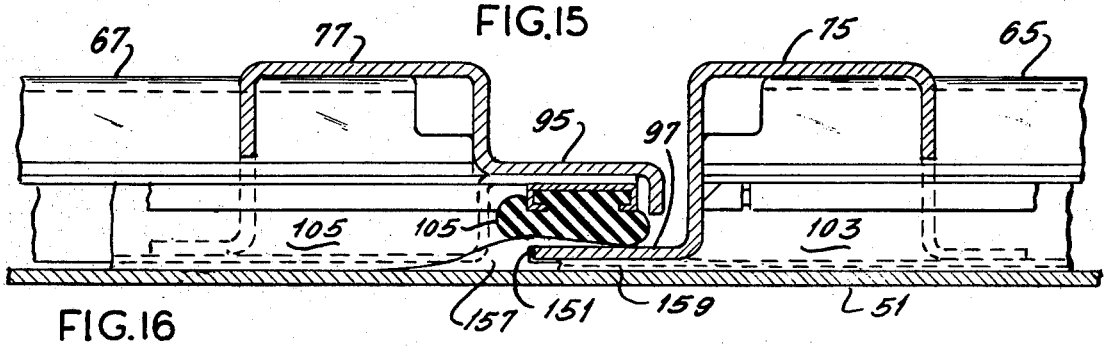
FIG. 16 is an enlarged fragmentary top view taken from the line 16—16 of FIG. 11.
Figure 17:
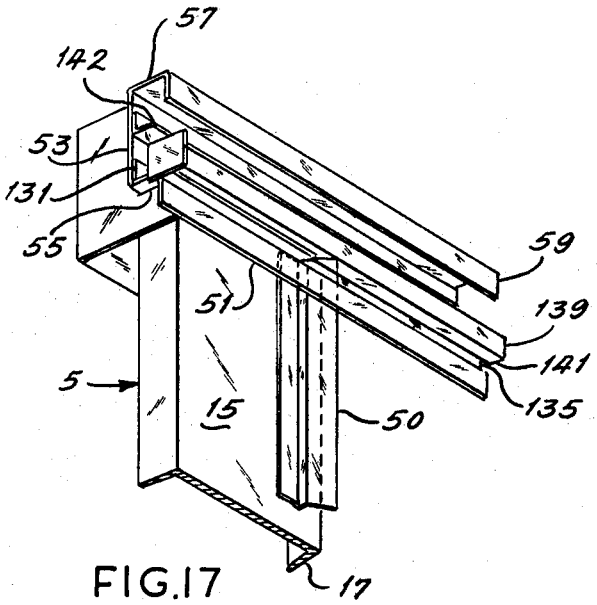
FIG. 17 is a slightly enlarged isometric view of the upper lefthand corner of the car structure illustrated in FIG. 1A.
Figure 18:
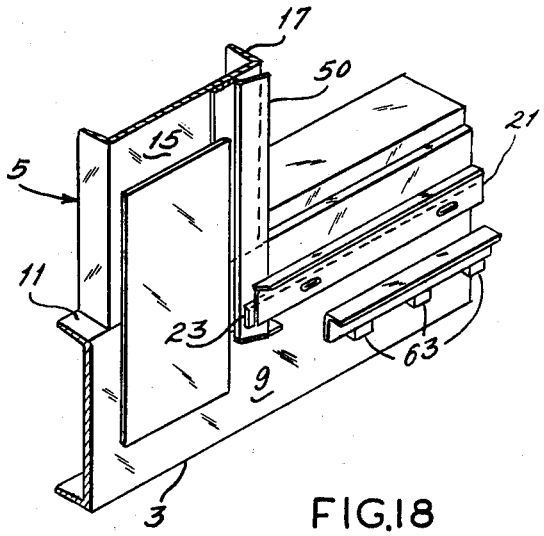
FIG. 18 is a slightly enlarged isometric view of the lower lefthand corner of the car side illustrated in FIG. 1A.
Figure 19:
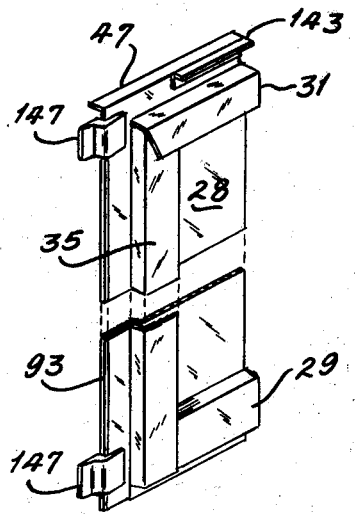
FIG. 19 is an isometric view of the lefthand side of the righthand sliding door.

Similarly, distortion of gasket 105 by the noncoplanar relation of flange 97 on center door 65 and the side plate and side sill outer surfaces is compensated for by small flaps 157 which are similar in construction to flat 147 except for an extension 159 along the inner surface of flange 97 to the end of the upper and lower legs of three-sided gasket 103 on center door 65 with which it merges and to which it is preferably bonded, as best seen in FIGS. 15 and 16. Extensions 159 eliminate any gaps between flaps 157 and the upper and lower legs respectively of three-sided gasket 103 behind flange 97, thus providing a continuous seal between the doors and the side plate and side sill respectively in the region of flange 97.

Figure 3:
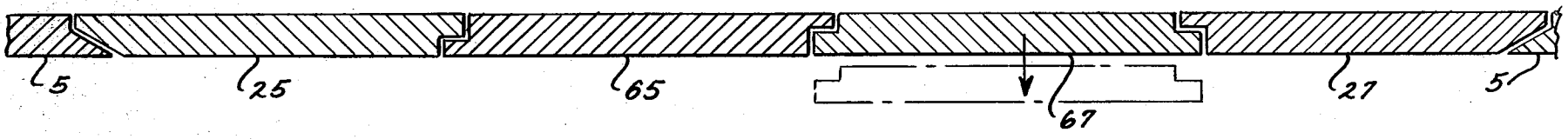
FIG. 3 is a schematic illustration corresponding to FIGS. 2A and B combined, showing the relationship of the doors to each other and to the corner posts when all doors are in closed position.
Figure 4:
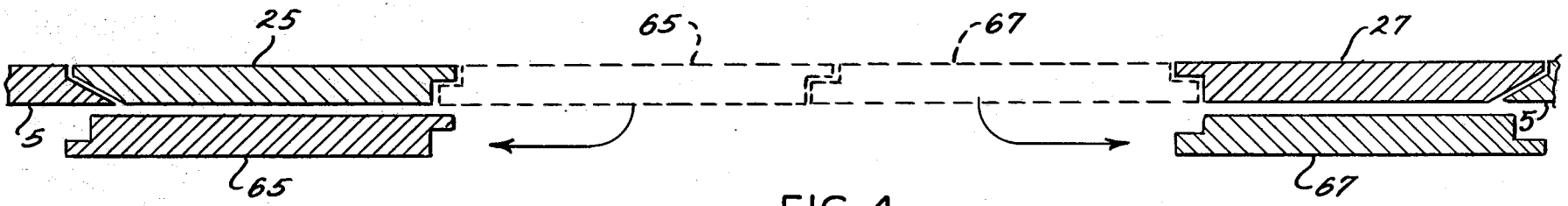
FIGS. 4, 5 and 6 are schematic illustrations similar to FIG. 3 showing the relationship of the doors when opened to form alternately positioned openings.
Figure 5:
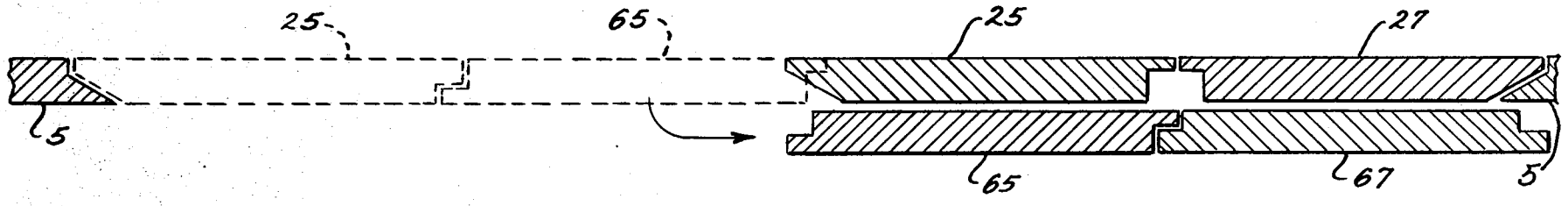

Operation of the structure is as follows and can be best seen principally by reference to FIGS. 3–6:

With the doors in the closed position as shown in FIG. 3, operating handle 126 on center door 67 is rotated to cause shafts 107 and 109 to rotate and thereby move center door 67 outwardly from the flush position shown in FIG. 3 to the outboard position shown in broken lines in FIG. 3. If it is desired to provide a large central opening, as shown in FIG. 4, center door 67 may be slid lengthwise of the car to the right to overlie main door 27 and center door 65 may be similarly moved outwardly from its initial flush closed position shown in FIG. 3 and then slid lengthwise of the car to the left to overlie end door 25. If it is desired to provide a large opening at the left end of the car side, as shown in FIG. 5, center door 65 is moved transversely outwardly and then slid lengthwise of the car to the right into abutting engagement with center door 67 and end door 25 is slid lengthwise of the car into abutting relation with end door 27 and underlying relation with center door 65. Conversely, if it is desired to provide a large opening at the right hand end of the car side, center door 67 is first moved transversely outwardly followed by center door 65 and both of center doors 65 and 67 are slid toward the left end of the car side and end door 27 is slid lengthwise of the car side to the left into abutting engagement with end door 25 and underlying relation with center door 67.

Figure 10:
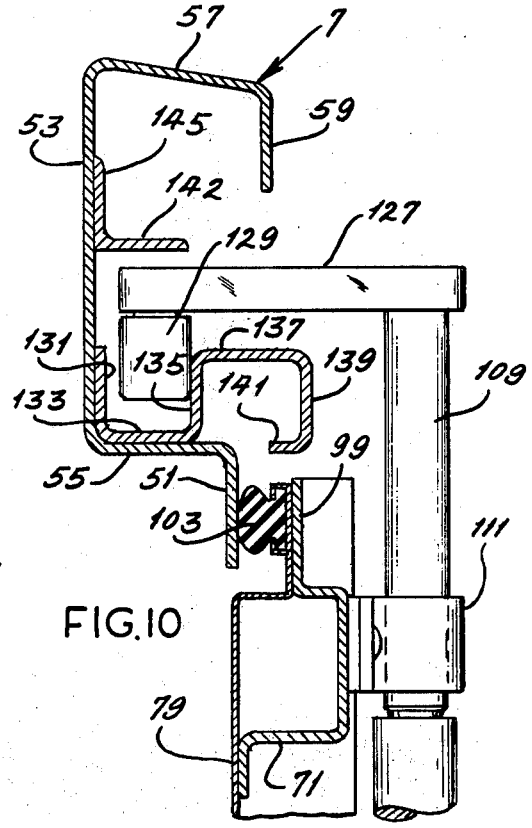
Figure 11:
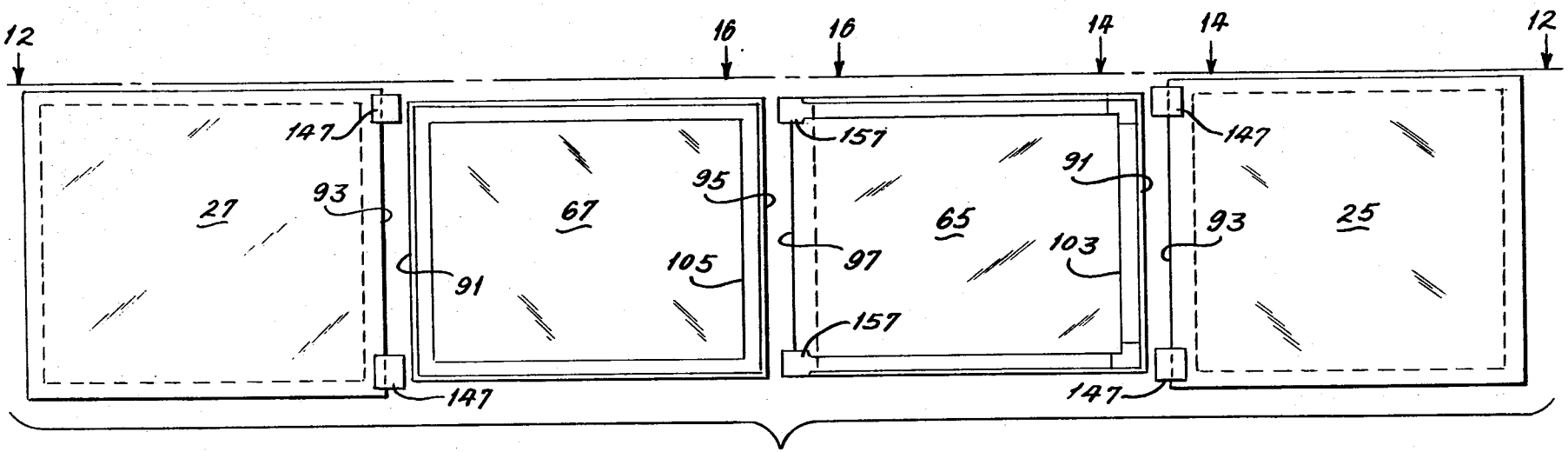
FIG. 11 is a simplified inside elevational view, taken from line 11—11 of FIG. 12, of all four doors separated to show the gasket arrangement.

For returning the doors to closed position from the open position of FIG. 4 to the closed position of FIG. 3, center door 65 is first slid longitudinally of the car to a position abrest of its closed position, and its operating handle 126 is rotated to cause corresponding rotation of shafts 107 and 109 and cranks 113 and 127 to force it inwardly until top and bottom portions of its gaskets 103 are compressed against the side sill and side plate, as best seen in FIGS. 8 and 10 and the vertical portion of gasket 103 is compressed against edge flange 93 of end door 25, the void caused in the top and bottom corner portions of center door gasket 103 by the noncoplanarity of end door flange 93 and side plate flange 51 and side sill 9 being filled by tapered flaps 147 on end door flange 93. Center door 67 is then slid lengthwise of the car to a location abreast of its normal closed position and is moved transversely inwardly by operation of operating handle 126 so that the top and bottom portions of its gasket 105 are compressed into sealing engagement with opposed surfaces of the side plate and side sill and its vertical edge flange 91 adjacent end door 27 compresses the portion of gasket 105 mounted thereon against vertical edge flange 93 of end door 27. At the same time, the vertical edge flange 95 of center door 67 overlying vertical edge flange 97 of center door 65 compresses the corresponding vertical edge of gasket 105 against edge flange 97, and the voids at the corners of gasket 105 caused by the non-coplanarity of vertical edge flanges 93 and 97 with the side plate and side sill surfaces are filled by flaps 147 and 157 mounted on flanges 93 and 97.

The doors are returned to the closed position from the open position shown in FIG. 5 by sliding end door 25 to the left until its edge flange terminal 49 is wedgingly engaged by vertical stop member 50 on end post 5 to prevent further longitudinal movement of end door 25 and wedge the corresponding edge of end door 25 into tight engagement with corner post 5. Center door 65 is then slid lengthwise of the car to a position abreast of its normal closed position and is moved transversely inwardly into closed position as described above in connection with the closure of the FIG. 4 opening, and center door 67 is similarly slid to the left and moved transversely inwardly to closed position in the manner described above.

Figure 6:
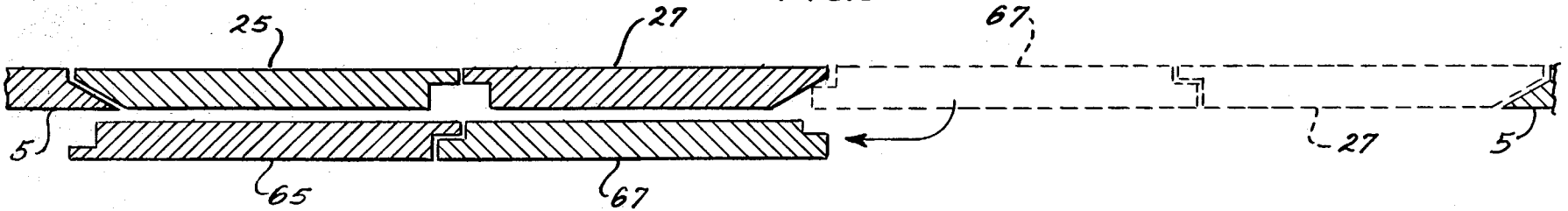

For returning the doors to closed position from the position shown in FIG. 6, end door 27 is slid lengthwise of the car until its vertical edge flange terminal 49 underlyingly engages door end stop 50 on the right hand corner post 5, thus wedging edge flange 49 into tight engagement with the corner post 5, and center doors 65 and 67 are both slid lengthwise of the car to the right until center door 65 is abreast of its normal closed position, whereupon it is moved transversely into its normal closed position followed by corresponding inward movement of center door 67.

During movements of the car, any vertical deflections of side plate 7 resulting from its great unsupported length will not result in separation of top retainer cranks 127 from the top retainer rail, because even though some such vertical deflection may occur, vertical movement of the retainer rollers 129 out of their retainer channel will be prevented by ledge 142 which overlies the retainer crank inner terminals. This would also limit vertical movement of the side plate and top retainer rail member with respect to the retainer crank rollers 129 and would thus substantially reduce frictional wear between rollers 129 and the intermediate vertical web 135 of the S-section retainer rail member. Even if substantial wear did take place between rollers 129 and web 135, the center doors would still be held against falling off the car side by the presence of outer horizontal web 137 and vertical outer flange 139 of the retainer rail. Vertical deflection of the central portion of the side plate would also be further resisted by the substantial section of the S-shaped retainer members 131–141. Although the S-section retainer rail member substantially reinforces the side plate and virtually eliminates the likelihood of failure of the top retainer means, some saving in the overall weight of the car is achieved by the fact that both top retainer rails for the center doors, as well as for the end doors, are formed of a single member. The downwardly slotted box section of the outer end door retainer rail portion of the S-section retainer member also cooperates with the T-section upper edge of the end doors to effectively oppose their separation from the retainer and consequent falling off the car side. In the unlikely event of separation of top retainer cranks 127 from the top retainer rail or failure of the cranks, safety retainer crank 144 will prevent complete separation of the top of the respective center door from the car wall and its consequent falling off the car side.

The details of the structure may be varied substantially without departing from the spirit of the invention and the exclusive use of such modifications as come within the scope of the appended claims is contemplated.

We claim:

1. In a wall having a horizontally elongated rectangular opening, a pair of parallel horizontal tracks on the wall beneath said opening, a pair of end doors mounted in spaced apart relation on one of said tracks for sliding movement lengthwise of said wall, door stops on the wall adjacent the ends of said opening each wedgingly engageable with the adjacent end of one of said end doors to limit its movement lengthwise of the opening and to force the adjacent margin of the respective end door against the wall, center door structure mounted on said other track for movement transversely of the wall into and cut of a closed position in the space between said end doors and longitudinally of the car parallel to said end doors, said center door structure having vertical marginal portions overlyingly engageable with adjacent vertical marginal portions of said end doors when in the closed position for holding the adjacent marginal portions of said end doors against the wall.

2. In a wall according to claim 1, said center door structure comprising a pair of center doors, one of said center doors having its margin adjacent the other of said center doors in overlying abutting relation transversely of the wall with the margin of said other center door.

3. In a wall according to claim 2, said one center door having a resilient gasket along its top, bottom, and both of its vertical margins for sealing engagement when in the closed position respectively with the wall above and below said opening and with the underlying vertical margins of the adjacent end door and the other center door, said other center door having a resilient gasket along its top and bottom margins and along its vertical margin adjacent said one end door, said other center door gasket being sealingly engageable with the wall above and below said opening and with the underlying adjacent margin of said other end door.

4. In a wall according to claim 3, said underlying marginal portions of both said end doors and of said other center door being provided at their respective upper and lower ends with a tapered flap projecting longitudinally therefrom and adapted to underlie adjacent portions of the top and bottom gasket parts on the adjacent center door and fill in the void between said top and bottom gasket part portions and underlying portion of said wall above and below the opening caused by the non-coplanar relation between the outer surface of the door marginal flanges on said end doors and said other center door and the wall above and below said opening.

5. In a wall according to claim 1, said center door structure comprising a center door, spaced upright shafts journaled on said center door and mounting at their lower ends supporting cranks, carriages movable along said other track and pivotally supporting said cranks, said crank shafts mounting at their upper ends retainer cranks, said retainer cranks having rollers journaled on vertical axes at their respective terminals and depending therefrom, a top retainer rail for both said end and center doors comprising a generally S-shaped member consisting of an upwardly facing inner channel secured to the wall above said opening and a downwardly facing outer channel, said upwardly facing channel receiving said rollers on said top cranks, said end doors having a portion projecting upwardly into said outer channel to cooperate therewith and retain said end doors on said wall.

6. In a wall according to claim 5, a safety crank having an upright shaft journaled on said center door intermediate said upright shafts and having an anti-friction element dependingly mounted on its end remote from its shaft and extending into said upwardly facing channel, whereby to prevent separation of the upper portion of said center door from the wall in the event said first-named retainer cranks fail.

7. In a wall according to claim 5, a bracket secured to the upper surface of each said carriage and having a portion overlying the inner end of the respective door-supporting cranks, whereby to prevent the vertical separation of said cranks from said carriages.

8. In a wall according to claim 5, the portion thereof above said opening also mounting a ledge member overlying said inner channel and spaced thereabove to prevent vertical separation therefrom of said top crank rollers.

9. In a wall according to claim 8, the portion thereof above said opening having a vertical web and a horizontal outwardly extending flange with a depending terminal portion forming the header of said opening, said S-shaped member inner channel portion being secured to the wall top portion with its inner leg adjacent the vertical web thereof and its bottom web abutting said horizontal flange.

10. In a wall according to claim 9, the outer downwardly opened channel portion of said S-shaped member projecting partially beyond the outer edge of said horizontal flange and having its outer vertical flange bottom margin inwardly bent to define, with the outer edge of said horizonal flange, in elongated slot, said end door upwardly projecting portion comprising a vertical flange extending through said slot into the downwardly open channel portion thereabove.

11. In a wall according to claim 10, said upwardly extending flange on said end door having inwardly and outwardly extending horizontal flanges at its upper end of greater overall extent than the width of said slot, whereby to provide an interlock between the upper edge of said end doors and said downwardly open outer channel to oppose vertical separation of said end doors from said outer channel.

12. In a wall according to claim 11, said wall top portion being the side plate of a railway house car and being formed along the upper margin of said web with an outwardly extending substantially horizontal flange having a downwardly bent outer terminal.

13. In a wall according to claim 11, an abutment on the wall beneath each of said end doors facing away from the respective end of said opening, and a lever fulcrumed on each of said end doors near the lower edge thereof and projecting therebelow for engagement with said abutment, whereby upon manual rotation of said lever about its fulcrum into abutting engagement with said abutment the respective end door is unwedged and its movement toward opening position initiated.

14. In a wall according to claim 13, means on said door limiting pivotal movements of said lever to nearly upright positions in opposite directions from a vertical position.

15. In a wall, an elongated horizontal bottom member, a pair of upright members spaced apart lengthwise of said bottom member, and an elongated horizontal top member spaced vertically from said bottom member and connected to said upright members to define with said upright members and said bottom members, and elongated rectangular door opening, a first horizontal track mounted on and parallel to said bottom member, a first door mounted on and movable longitudinally along said track between respective positions therealong partially closing parts of said opening, a second horizontal track mounted on said bottom member and extending parallel thereto alongside said first track, carriages movable along said second track, upright crank shafts pivotally mounted on said carriages, a second door mounted on said crank shafts and movable along and transversely of said second track to an advanced position in which said second door is in end relation with said first door and to a position in which it is positioned transversely outwardly of said first door and alongside the same, said crank shafts extending above said doors and mounting retainer cranks at their upper ends, said top member having a longitudinally extending top retainer for said doors comprising a generally S-section member formed with an upwardly facing inner channel and a downwardly facing outer channel, said downwardly facing channel forming a top retainer for said first door and retainably receiving the upper edge of said first door, said upwardly facing channel forming a top retainer for the second door and receiving members depending from the terminals of said top retainer cranks, said downwardly facing channel portion of said S-section top retainer member providing additional safety means opposing separation of said top crank depending elements from said upwardly facing channel.

16. In a wall according to claim 15, said top member having an outwardly projecting horizontal ledge overlying said inner channel and spaced vertically therefrom sufficiently to clear said cranks and closely enough thereto to prevent vertical separation of said cranks from said inner channel.

17. In a wall according to claim 16, said top member having a vertical web and a horizontal flange extending outwardly from the lower margin thereof and having its outer margin rebent vertically downwardly to form a header on said door opening, said upwardly facing inner channel of said S-section retainer member being secured to said top member with its inner and bottom portions in abutting relation with said top member web and horizontal flange.

18. In a wall according to claim 17, said downwardly facing outer channel of said S-section retainer member projecting outwardly from said top member horizontal flange.

19. In a wall according to claim 18, said downwardly facing channel having an outer vertical flange with its lower margin bent inwardly at substantially the same level as said top member horizontal flange to define therewith a downwardly open slot, said upper edge of said first door passing through said slot and having a double flange formed along its upper margin.

20. In a wall according to claim 15, said first track being at a higher level than said second track and said second track being offset therefrom away from said bottom member.

21. In a wall according to claim 20, a pair of said first doors normally positioned adjacent the ends of said opening and a pair of said second doors positioned in side-by-side relation with each other and with said first door to fully close said opening.

22. In a wall according to claim 21, the marginal portions of said second doors nearest said first doors overlapping the adjacent marginal portions of said first doors and the marginal portion of one of said second doors overlapping the adjacent marginal portion of said other second doors to effect seals between said adjacent door members.

23. In a wall according to claim 22, said posts mounting upright door stop members adjacent the edges of said opening, said door stop members having vertical webs inclined in the horizontal plane toward said posts in a direction away from the door opening, said first doors having upright edge members adjacent said posts similarly inclined for sliding engagement with said door stop members when said first doors are in their fully closed positions, whereby to limit the movements of said first doors and urge said first doors inwardly transversely of said opening into sealing engagement with the other surfaces of said top member, said end posts, and said bottom member.

24. In a wall, an elongated horizontal member defining the top of an opening therein and having a common top retainer for a first door of the longitudinal sliding type and a second door of the laterally and longitudinally movable type arranged to close said opening jointly, said top retainer comprising a generally S-section member formed with an upwardly facing inner channel and a downwardly facing outer channel, said downwardly facing channel being adapted to retainably receive the upper edge of the first door, said upwardly facing channel being adpated to receive members depending from the terminals of top retainer cranks on the second door, said downwardly facing channel portions of said S-section top retainer member providing safety means opposing separation of the top retainer crank depending element from said upwardly facing channel.

25. In a wall according to claim 24, said elongated horizontal member having an outwardly projecting horizontal ledge overlying said inner channel and spaced vertically therefrom sufficiently to clear the top retainer cranks and closely enough thereto to prevent vertical separation of the top retainer cranks from said inner channel.

26. In a wall according to claim 25, said elongated horizontal member having a vertical web and a horizontal flange extending outwardly from the lower margin thereof and having its outer margin rebent vertically downwardly to form a header on the door opening, said upwardly facing inner channel of said S-section retainer member being secured to said elongated horizontal member with its inner and bottom portions in abutting relation with said elongated member web and horizontal flange.

27. In a wall according to claim 26, said downwardly facing outer channel of said S-section retainer member projecting outwardly from said elongated member horizontal flange.

28. In a wall according to claim 27, said downwardly facing channel having an outer vertical flange with its lower margin being inwardly at substantially the same level as said elongated member horizontal flange to define therewith a downwardly open slot adapted to permit the passage therethrough of the upper edge of the first door and to accommodate a double flange formed along the upper margin of the first door upper edge.

* * * * *

UNITED STATES PATENT OFFICE

CERTIFICATE OF CORRECTION

Patent No. 4,048,755 Dated September 20, 1977

Inventor(s) Norbert S. Wolak and Thomas J. Wolak

It is certified that error appears in the above-identified patent and that said Letters Patent are hereby corrected as shown below:

Column 3, line 53, "the protrude" should be --and protrude--;
line 62, "To edge member" should read --Top edge members--.
Column 9, line 59, "cut" should be --out--.
Column 11, line 8, "in" should be --an--.
Column 12, line 60, "other" should be --outer--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*